US011466450B2

(12) United States Patent
Harris

(10) Patent No.: US 11,466,450 B2
(45) Date of Patent: Oct. 11, 2022

(54) PANEL ENCLOSURE SYSTEM

(71) Applicant: Lazarus Harris, Florence, MS (US)

(72) Inventor: Lazarus Harris, Florence, MS (US)

( * ) Notice: Subject to any disclaimer, the term of this patent is extended or adjusted under 35 U.S.C. 154(b) by 0 days.

(21) Appl. No.: 17/356,399

(22) Filed: Jun. 23, 2021

(65) Prior Publication Data

US 2021/0317656 A1 Oct. 14, 2021

Related U.S. Application Data

(63) Continuation-in-part of application No. 15/448,467, filed on Mar. 2, 2017, now abandoned.

(60) Provisional application No. 62/302,611, filed on Mar. 2, 2016.

(51) Int. Cl.

| | |
|---|---|
| ***E04B 2/82*** | (2006.01) |
| ***E04H 6/02*** | (2006.01) |
| ***E04B 2/74*** | (2006.01) |

(52) U.S. Cl.

CPC ..... *E04B 2/828* (2013.01); *E04H 6/02* (2013.01); *E04B 2002/747* (2013.01)

(58) Field of Classification Search

CPC ..... E04B 1/34321; E04B 2/7401; E04B 2/88; E04B 2/828; E04B 2002/747; E06B 2009/2423; E06B 2009/24581; E06B 2009/2447; E06B 9/24; E04H 6/02; E04H 15/642; E04F 10/02

USPC ..... 135/97; 160/89, 179

See application file for complete search history.

(56) References Cited

U.S. PATENT DOCUMENTS

| | | | | |
|---|---|---|---|---|
| 3,004,592 | A | 10/1961 | Norton | |
| 3,088,244 | A | 5/1963 | Commisso | |
| 4,145,855 | A | 3/1979 | Sheldon | |
| 4,296,579 | A | 10/1981 | Proud | |
| 4,557,311 | A * | 12/1985 | Reining | E04F 10/02 160/330 |
| 4,848,437 | A * | 7/1989 | Laniado | E06B 9/40 428/476.1 |
| 4,909,004 | A | 3/1990 | Panttila | |
| 5,323,835 | A | 6/1994 | Bachmeier | |
| 5,358,025 | A | 10/1994 | Wood | |
| 5,427,169 | A | 6/1995 | Saulters | |
| 6,079,473 | A | 6/2000 | Ackerson, II | |
| 7,320,353 | B1 | 1/2008 | Miller | |
| 7,946,333 | B1 | 5/2011 | Zapata | |
| 9,606,272 | B2 * | 3/2017 | Sandre-Chardonnal | G02B 5/0294 |
| 2017/0362813 | A1 * | 12/2017 | Harris | E04B 2/7401 |

* cited by examiner

*Primary Examiner* — Rodney Mintz
(74) *Attorney, Agent, or Firm* — Hulsey P.C.

(57) ABSTRACT

Disclosed is a panel enclosure system for enclosing partially unenclosed structures. The system includes a panel member assembly preferably comprising at least two panel members and a securing member that removably secures the panel member assembly over the unenclosed portion of a structure. The panel members of the panel member assembly may be individually removed to vary the degree of exposure to outdoor weather and environmental conditions. Preferably, the panel members comprising the panel member assembly vary in degree of transparency such that users may vary the level of visual exposure to the surrounding outdoor environment by adding or removing panel members.

13 Claims, 12 Drawing Sheets

PANEL ENCLOSURE SYSTEM

CROSS-REFERENCE TO RELATED APPLICATIONS

This application claims priority to U.S. application Ser. No. 15/448,467, filed Mar. 2, 2017, which claims priority to U.S. Provisional Patent Application 62/302,611, entitled "Panel Enclosure System," filed on Mar. 2, 2016; all of which are hereby incorporated by reference in their entirety.

FIELD OF INVENTION

The subject matter of the present disclosure refers generally to a panel enclosure system for enclosing unenclosed or partially unenclosed areas or structures.

BACKGROUND OF INVENTION

Individuals frequently work or engage in recreational activities in structures that leave them partially exposed to the outdoors. Such areas or structures may include patios, porches, carports, garages, or any other similar structures not fully enclosed from the outdoors. Because individuals within these structures are partially exposed to the outdoors they are also exposed to the weather and environmental conditions of the outdoors. Accordingly, adverse weather conditions can disrupt or even prevent an individual from being able to work or enjoy recreational activities within such structures. However, if the weather is not adverse but the surrounding environment is disruptive, individuals in such structures may not wish to completely insulate themselves from the outdoors. Rather, they may wish to filter out environmental disruptions, such as pests, allergens, or other debris, but still have some exposure to the outdoor weather. Moreover, because outdoor weather and environmental conditions fluctuate from day to day, individuals in partially unenclosed structures often need to vary their exposure to the outdoors in order to work or enjoy recreational activities in such areas or structures.

Additionally, when individuals work or engage in recreational activities in structures that are partially exposed to the outdoors, they are, in turn, exposed to the view of others in the surrounding environment. Thus, an individual generally lacks privacy while present in such structures. Accordingly, if an individual desires privacy, the individual must incorporate a barrier into the structure, which shields the individual from the view of others. Because the desire for privacy may vary from day to day, installing a single or permanent barrier for this purpose is not ideal, as doing so eliminates an individual's ability to vary his or her visual exposure to the surrounding environment.

Accordingly, a need exists in the art for a system for partially unenclosed structures that enables individuals to vary their exposure to outdoor weather and environmental conditions.

Furthermore, a need exists in the art for a system that achieves this end while also permitting individuals to vary their degree of visual exposure to the surrounding environment.

SUMMARY

The present disclosure is directed toward a panel enclosure system for enclosing partially unenclosed structures. Generally, the panel enclosure system comprises a panel member assembly and a securing member that removably secures the panel member assembly to a partially unenclosed structure. When installed, the panel member assembly creates an upright barrier between the inside of the partially unenclosed structure and the outdoors.

The panel member assembly preferably comprises at least two panel members. However, the system is designed such that individual panel members may be added or removed to enable users to customize the barrier established between the inside of the structure and the outdoors.

Accordingly, in some instances, users may remove panel members until only a single panel member establishes the aforementioned barrier. In one preferred embodiment, panel members may be added or removed by securing or unsecuring a panel member to the securing member, respectively. In another preferred embodiment, panel members may be added or removed by securing a panel member to or removing a panel member from another panel member within the panel member assembly, respectively.

To enable users to vary the degree of visual exposure between the interior of the structure and the outdoors, the panel members of the panel member assembly are of different transparencies. In one preferred embodiment, the panel member assembly comprises a first panel member that is opaque, a second panel member that is transparent, and a third panel member that is semi-transparent. In another preferred embodiment, the panel members of the panel member assembly are designed such that users may vary the degree to which the system guards against exposure to the weather and environmental conditions of the outdoors. For instance, in a preferred embodiment, one panel member of panel member assembly may be waterproof while another panel member of the panel member assembly may have a plurality of openings therein to permit air to pass therethrough.

To facilitate versatility and installation within a variety of partially unenclosed structures, the design of the securing member and number thereof used may vary depending on the nature of structure and desired application. In a preferred embodiment, the securing member is a trough configured to secure to a structure and receive one or more support members extending from at least one panel member within the panel member assembly therein. By sliding the one or more support members within the securing member, the panel member assembly can quickly transition from an enclosed to unenclosed position or vice versa.

In one implementation, the panel enclosure system includes a panel connecting system positioned at the panel member assembly. The panel connecting system connects either vertically or horizontally or any other form or shape to the panel enclosure system. The panel connecting system facilitates in connecting and separating a portion or entire panel member assembly from the structure. In one example, the panel connecting system comprises a zipper mechanism. The zipper mechanism comprises a first zipper connecting the structure and a second zipper connecting the panel member assembly. Each of the first zipper and the second zipper indicates a zipper tape. The first zipper and the second zipper receive a zipper slider. The user operates the zipper slider by sliding it along the first zipper and the second zipper for connecting and separating the panel member assembly from the structure.

In another example, the panel connecting system comprises a combination of a zipper mechanism and a hook and loop mechanism. The hook and loop mechanism comprises a strip. The strip connects to the structure. Here, the strip comprises loops. The hook and loop mechanism further comprises a first zipper. The hook and loop mechanism comprises hooks drawn through the loops and connecting the first zipper. The zipper mechanism comprises a second zipper connecting the panel member assembly. The first zipper and the second zipper receive a zipper slider. From the above, it is clear that the zipper mechanism is placed adjacent to the hook and loop mechanism. In operation, the user operates the zipper slider by sliding it along the first zipper and the second zipper for connecting and separating the panel member assembly from the structure.

Further, the panel enclosure system comprises an assembly containment pouch. The panel member assembly folds and allows placing it in the assembly containment pouch. The assembly containment pouch comprises a handle allowing the user to carry it.

The foregoing summary has outlined some features of the system of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the device and methods disclosed herein. Those skilled in the pertinent art should also realize that such equivalent designs or modifications do not depart from the scope of the system of the present disclosure.

BRIEF DESCRIPTION OF THE DRAWINGS

These and other features, aspects, and advantages of the present disclosure will become better understood with regard to the following description, appended claims, and accompanying drawings where:

DETAILED DESCRIPTION OF THE EMBODIMENTS

Figure 1:
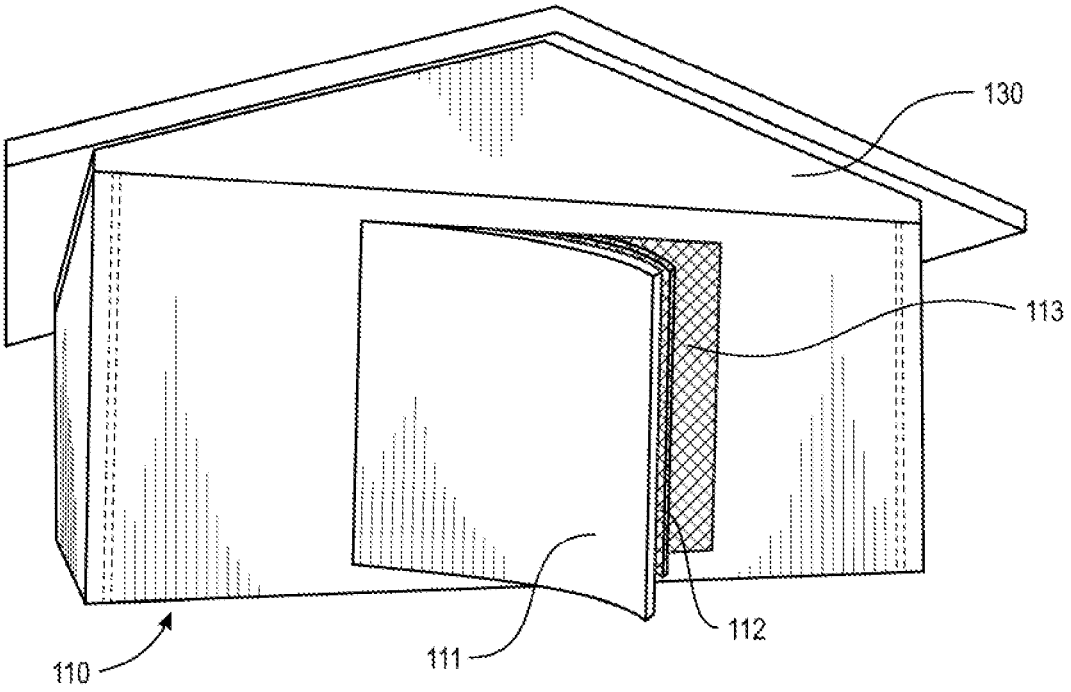
FIG. 1 shows a perspective view of an enclosure system embodying certain features consistent with the principles of the present disclosure installed on a stand-alone carport.

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility). The term "removably secured" and grammatical equivalents thereof are used herein to mean the joining of two components in a manner such that the two components are secured together, but may be detached from one another without requiring the use of specialized tools.

Turning now to the drawings, FIGS. 1-16 illustrate preferred embodiments of a panel enclosure system, or various components thereof, for enclosing partially unenclosed structures. The panel enclosure system or simply referred to as system 100 is designed to establish an upright barrier when installed that may be customized to fit a user's needs by adding or removing panel members, as described herein. The system 100 has a panel member assembly 110 that acts as the upright barrier between the interior of a structure 130 and the outdoors. A securing member 120 is used to removably secure the panel assembly 110 to the structure 130.

The panel member assembly 110 comprises at least two panel members, a first panel member 111 and a second panel member 112. In a preferred embodiment, the panel member assembly 110 further comprises a third panel member 113, as shown in FIGS. 1-2, 4-7, and 9. The transparency of each panel member within the panel member assembly 110 is preferably different from the transparency of the other panel members within the panel member assembly 110. As shown in FIGS. 2, 4, and 6-7, in one preferred embodiment, the first panel member 111 may be opaque, the second panel member 112 may be transparent, and the third panel member 113 may be semi-transparent. The use of panel members having different transparencies enables users to vary the degree of visual exposure from the inside the structure to the outdoor environment by adding or removing panel members in the manner described herein. Because each panel member has a different transparency, each panel member, in turn, permits a different amount of light to pass therethrough. Accordingly, adding or removing panel members from, the panel member assembly 110 to regulate temperature within a structure 130 enclosed or partially enclosed by the system 100 of the present disclosure.

Figure 5:
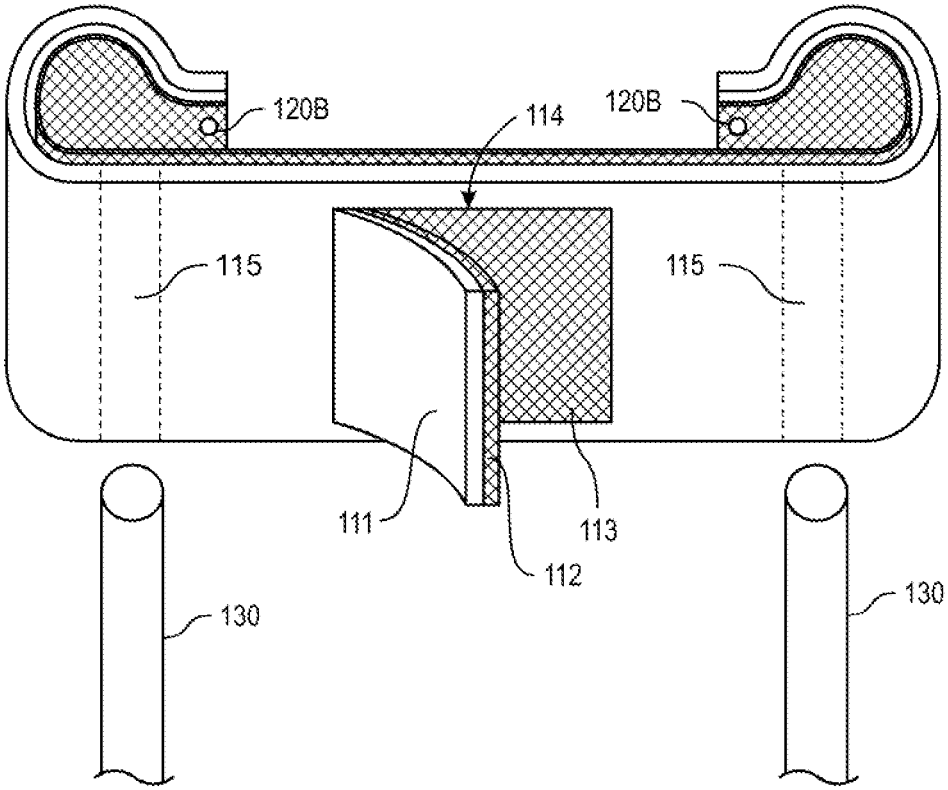
FIG. 5 shows a front elevational view of an enclosure system embodying features consistent with the principles of the present disclosure being installed onto two upright structures.
Figure 6:
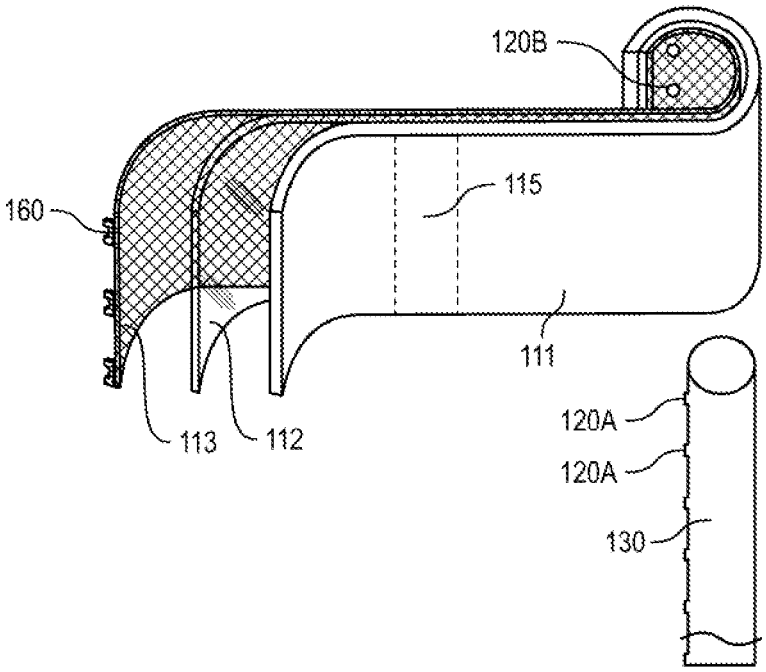
FIG. 6 shows a front elevational view of an enclosure system embodying features consistent with the principles of the present disclosure being installed onto an upright structure.
Figure 7:
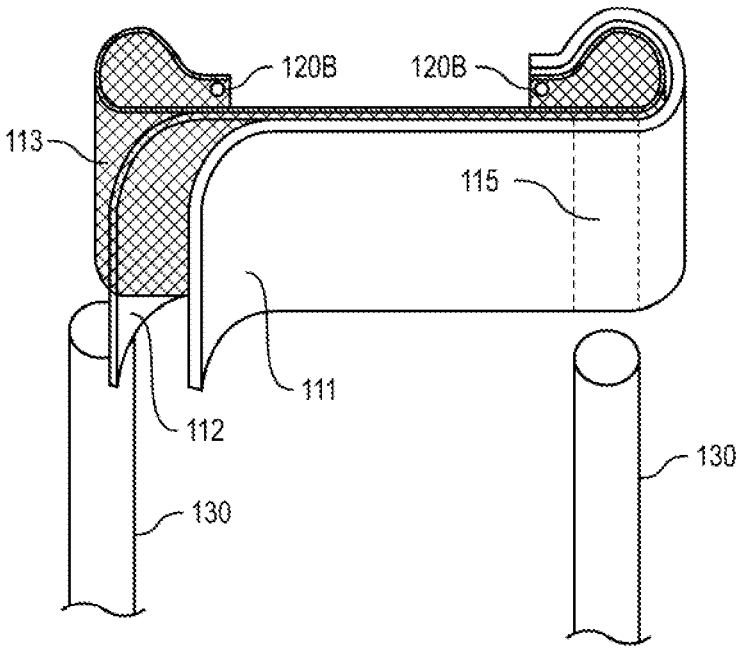
FIG. 7 shows a front elevational view of an enclosure system embodying features consistent with the principles of the present disclosure being installed onto two upright structures.

In one preferred embodiment, at least one panel member within the panel member assembly 110 has one or more stretchable sections 115, as shown in FIGS. 5-7. The one or more stretchable sections 115 are configured to permit the panel members to stretch to an elongated configuration. The one or more stretchable sections 115 may be vertically oriented within a panel member of the panel member assembly 110, as shown in FIGS. 5-7, thereby facilitating horizontal elongation of the panel member. Alternatively, the one or more stretchable sections 115 may be horizontally oriented within a panel member of the panel member assembly 110 (not shown), thereby facilitating vertical elongation of the panel member.

As shown in FIGS. 1 and 5, one or more panel members within the panel member assembly 110 may be designed to have a detachable portion and a non-detachable portion in some embodiments. Preferably, the first panel member 111, the second panel member 112, and the third panel member 113 each comprise a detachable portion and a non-detachable portion. The detachable portion is removably secured to the non-detachable portion. The detachable portion may be removably secured to the non-detachable portion via snap buttons, hooks, zippers, hook and loop fasteners, or any other device or instrument suitable for removably securing two objects. The non-detachable portion preferably has an opening 114 substantially the same size as the detachable portion. When the detachable portion is removed from the non-detachable portion the opening 114 may serve as entryway to or an exit from the structure 130.

Figure 4:
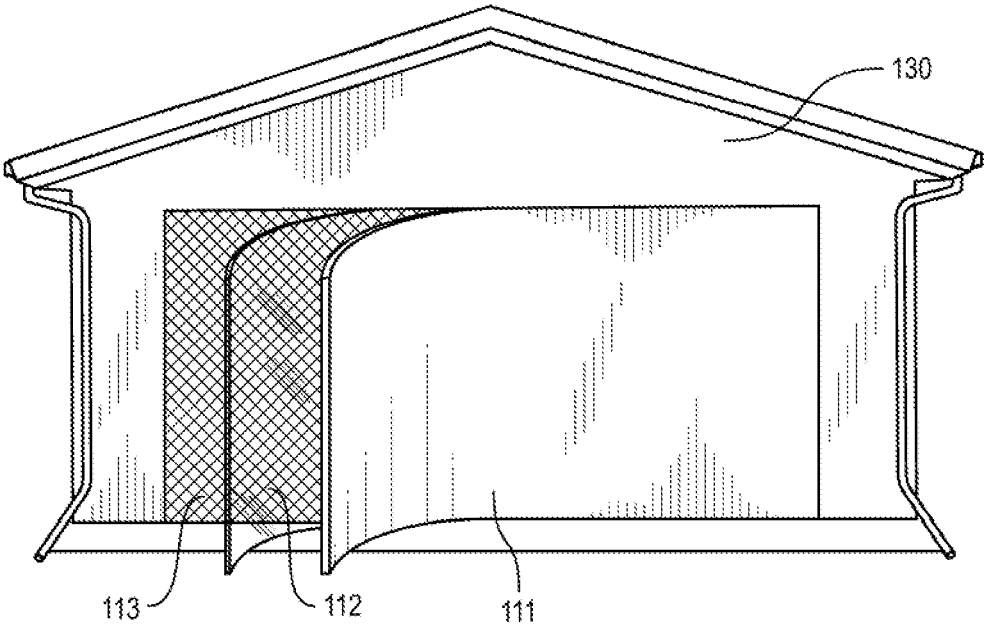
FIG. 4 shows a front view of a panel member assembly embodying features consistent with the principles of the present disclosure installed on the unenclosed portion of a standard garage.

As best shown in FIGS. 1 and 4, in a preferred embodiment, each panel member within the panel member assembly 110 is of a sufficient width and height to cover the unenclosed portion of a building, such as the opening to a carport or garage. A person skilled in the art will appreciate the system 100 disclosed herein may be installed in or find application with other structures 130. Such structures may include, but are not limited to, trees, fence posts, columns, or any other structure to which the panel member assembly 110 may be secured thereto via the securing member 120. As best shown in FIG. 4, in a preferred embodiment each panel member within the panel member assembly 110 is generally rectangular in shape having a first side, second side, top side, and bottom side. However, one of skill in the art will appreciate that the panel members of the panel member assembly 110 may be of any suitable shape or size without departing from the inventive subject matter of the system 100 disclosed herein.

The panel members within the panel member assembly 110 may be made of a solid material, i.e., not having holes or openings therein, or may be made of a material having a plurality openings therein. To enable users to vary their exposure to outdoor environments and weather conditions, it is preferred that at least one panel member within the panel member assembly 110 be made of a solid material and at least one panel member within the panel member assembly 110 be made of a material having a plurality of openings therein. In one preferred embodiment, the first panel member 111 and second panel member 112 are made of solid material and the third panel member 113 is made of a material having a plurality of openings therein. Preferably the plurality of openings within the third panel member 113 are of sufficient size to permit air to flow therethrough while excluding allergens and/or insects including, but not limited to, mosquitos, flies, bees, etc.

Because the panel member assembly 110 may be subjected to adverse weather conditions during use, it is generally preferred that at least one panel member within the panel member assembly 110 be waterproof and/or water resistant material. To that end, it is also generally preferred that at least one panel member within the panel member assembly 110 be windproof and/or wind resistant. The panel members within the panel member assembly 110 may be made of canvas, plastic, mesh, rubber, or any other suitable material. The first panel member 111, the second panel member 112, and the third panel member 113 may be made of the same material or different materials. For instance, the first panel member 111 may be made of a canvas material, the second panel member 112 may be made of a plastic material, and the third panel member 113 may be made of a mesh material.

Figure 3A:
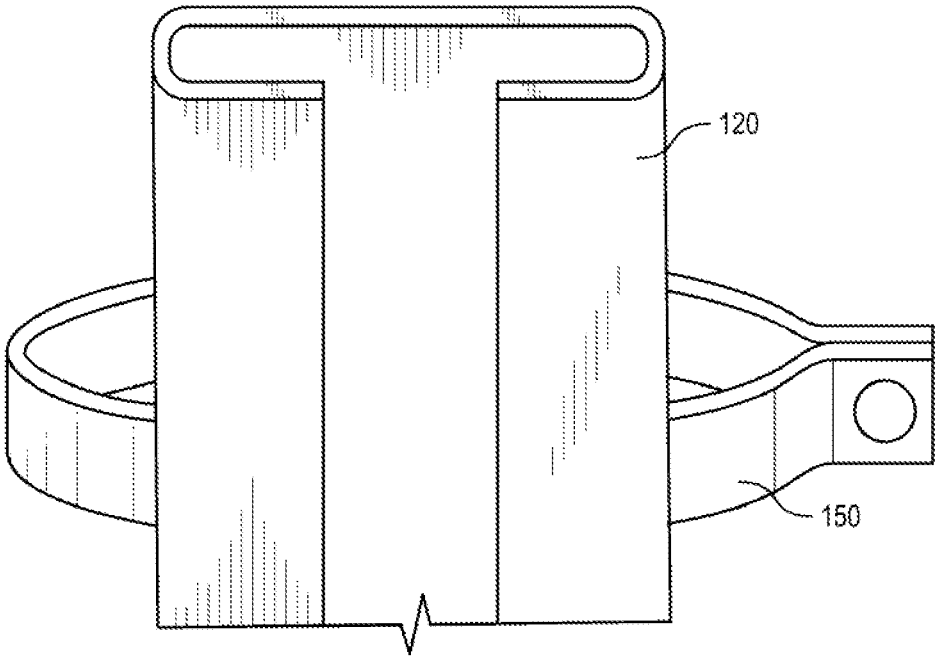
FIG. 3A shows a perspective view of a securing member embodying features consistent with the principles of the present disclosure.
Figure 3B:
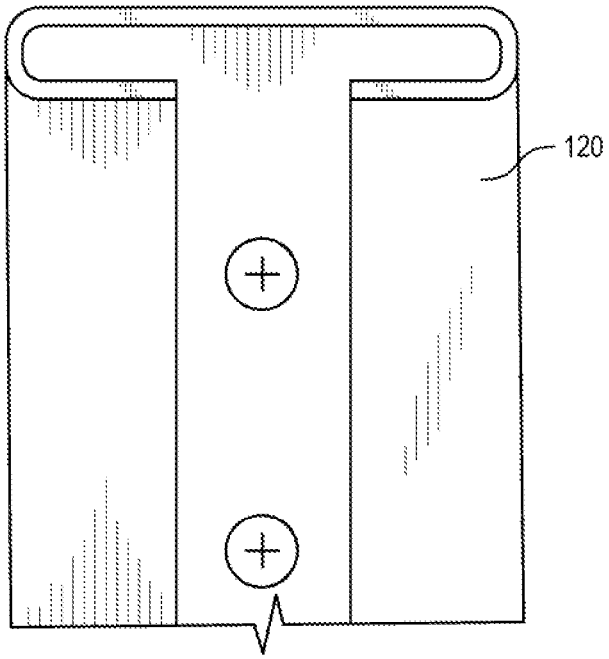
FIG. 3B shows a perspective view of a securing member embodying features consistent with the principles of the present disclosure.
Figure 9:
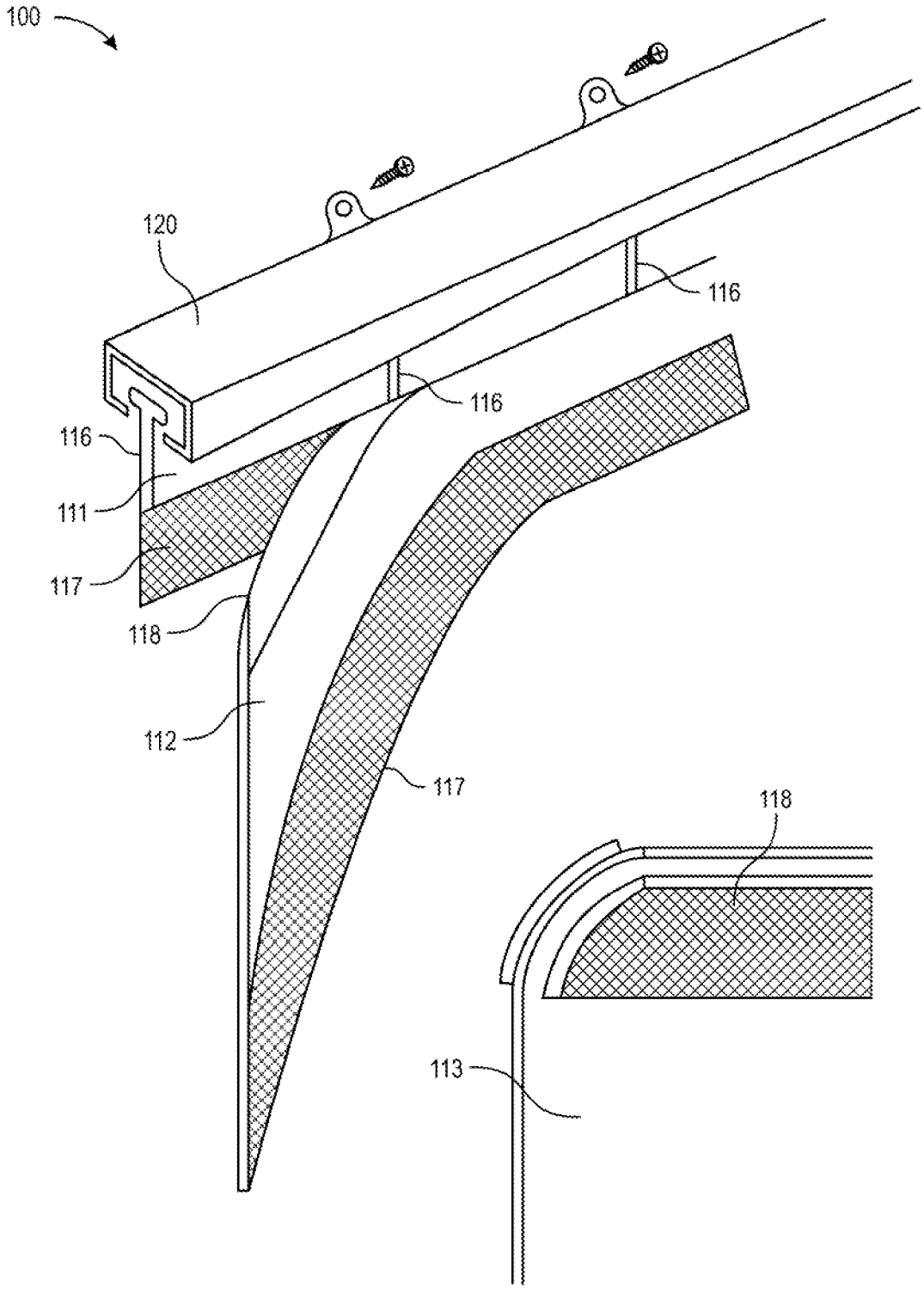
FIG. 9 shows a panel enclosure system embodying features consistent with the principles of the present disclosure.

To enclose the unenclosed portion of a structure 130, the panel member assembly 110 is secured in a generally upright position over the unenclosed portion of the structure 130 via the securing member 120. Before securing the panel member assembly 110 to the securing member 120, it is preferred that the securing member 120 first be secured to the intended structure 130. Preferably, the securing member 120 is removably secured to the structure 130. As shown in FIGS. 3B and 9, the securing member 120 may be removably secured via one or more screws, nuts and bolts, nails, or other similar instruments or devices. As shown in FIG. 3A, in one preferred embodiment, the securing member 120 may have a shackle 150 attached thereto that is configured to wrap around an upright structure 130 and lock in place, thereby securing the securing member 120 to the structure. Alternatively, the securing member 120 may be permanently secured to a structure 130. In some instances, the use of more than one securing member 120 may be needed to secure the panel member assembly 110 over the unenclosed portion of the structure 130. Preferably, the securing member 120 is designed to removably secure the panel member assembly 110 to a structure 130 to facilitate simple installation and removal of the system 100.

In one preferred embodiment, the securing member 120 secures the panel member assembly 110 over the unenclosed portion of a structure 130 by securing a single panel member within the panel member assembly 110 to the structure 130. In such embodiments, each panel member within the panel member assembly 130 is removably secured to at least one other panel member within the panel member assembly 110. In one preferred embodiment, the first panel member 111 is removably secured to the second panel member 112, and the second panel member 112 is removably secured to the third panel member 113.

The panel members within the panel member assembly 110 may be removably secured to one another via one or more connecting members. The connecting members used to removably secure the panel members together may include, but are not limited to, hook and loop fasteners, snap buttons, zippers, magnets, or any other device or instrument configured to removably secure to objects together. Accordingly, in some preferred embodiments, each panel member within the panel member assembly 110 may have a first connecting member 117 and/or a second connecting member 118 attached thereto. The first connecting member 117 and second connecting member 118 are configured to interlock or otherwise secure together. As shown in FIG. 9, in one preferred embodiment, the first panel member 111 has a first connecting member 117, the second panel member 112 has a first connecting member 117 and a second connecting member 118, and the third panel member 113 has a second connecting member 118. The first connecting member 117 of the first panel member 111 and the second connecting member 118 of the second panel member 112 removably secure the first panel member 111 and the second panel member 112 together, and the first connecting member 117 of the second panel member 112 and the second connecting member 118 of the third panel member 113 removably secure the second panel member 112 and third panel member 113 together. Thus, panel members may be removed from or added to the panel member assembly 110 by unsecuring or securing the first connecting member 117 of one panel member with the second connecting member 118 of another panel member, respectively. In a preferred embodiment, each panel member within the panel member assembly 110 has a first connecting member 117 secured to one face of the panel member and a second connecting member 118 secured to second face of the panel member, wherein the first face is opposite of the second face.

Figure 10:
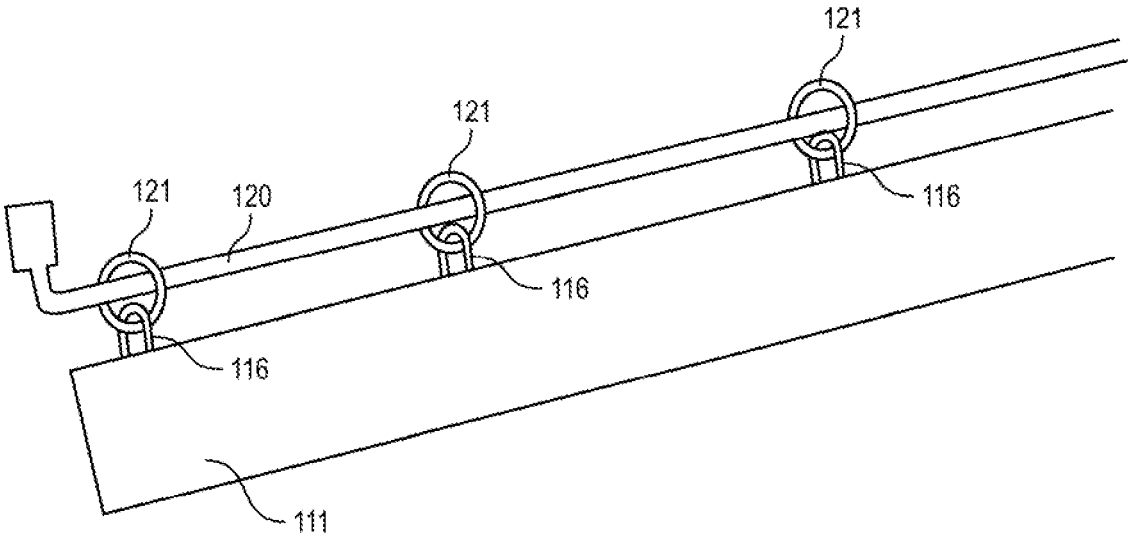
FIG. 10 shows a panel enclosure system embodying features consistent with the principles of the present disclosure.

In a preferred embodiment, at least one panel member within the panel member assembly 110, has a side having one or more support members 116 extending therefrom. For instance, as shown in FIG. 9, the first panel member 111 may have one or more support members extending from its top side while the second panel member 112 is removably secured to the first panel member 111 and the third panel member 113 is removably secured to the second panel member 112. To secure the panel member assembly 110 to the structure 130, the securing member 120 is configured to receive the one or more support members 116 such that the panel members of the panel member assembly 110 may hang downwardly from the securing member 120. To ensure the panel member assembly 110 covers the opening or unenclosed portion of the structure 130, the securing member is preferably secured above the unenclosed portion of the structure 130, e.g., above the opening of a garage. In a preferred embodiment, the securing member 120 is a trough that substantially spans the width of the panel member assembly 110 and is designed to permit the support members 116 to slide about therein. Alternatively, the securing member 120 may be a bar having one or more receiving members 121 positioned thereon that are configured to receive the one or more support members 116 therein, as shown in FIG. 10. Thus, in some embodiments, the panel member assembly 110 may transition from an enclosed configuration to an unenclosed configuration, or vice versa, by sliding the one or more support members 116 within the securing member 120.

In some embodiments, the securing member 120 may comprise a first fastener 120A and a second fastener 120B, wherein the first fastener 120A and second fastener 120B are configured interlock or otherwise secure or attach to one another. In a preferred embodiment, both the first fastener 120A and the second fastener 120B are attached to the panel member assembly 110.

Alternatively, the first fastener 120A may be secured to a structure 130 while the second fastener 120B is secured to the panel member assembly 110, as shown in FIG. 6. In some embodiments, each panel member within the panel member assembly 110 may have a first fastener 120A and/or second fastener 120B attached thereto. The first fastener 120A may be the male component and the second fastener 120B may be the female component of a device or instrument configured to removably secure two objects together, or vice versa. Thus in some embodiments, panel members may be added or removed from the panel member assembly 110 by engaging or disengaging fastening members.

Figure 2:
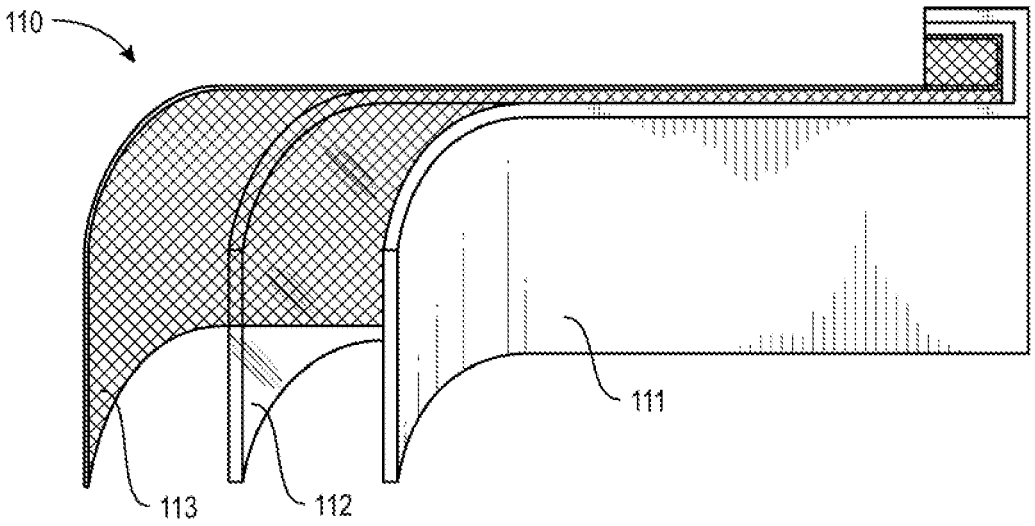
FIG. 2 shows a perspective view of a panel member assembly embodying features consistent with the principles of the present disclosure.

In other embodiments, the securing member 120 removably secures the panel member assembly 110 to a structure 130 by securing each panel member within the panel member assembly 110 to the structure. As shown in FIGS. 3A-3B, the securing member 120 may be a bracket configured to receive and/or interlock with one or more sides of each panel member within the panel member assembly 110. In such embodiments, at least one side of each panel member within the panel member assembly 110 is preferably crimped. As shown in FIG. 2, one side of the first panel member 111, the second panel member 112, and the third panel member 113 are crimped to retain a hook-like shape such that when placed within the securing member 120 shown in FIG. 3A or 3B, the crimped side of each panel member and the securing member 120 interlock. Thus, to remove a panel member from the panel member assembly 110, users remove the crimped side of the desired panel member from the securing member 120.

Alternatively, each panel member within the panel member assembly 110 may have a side having one or more hooks 160 attached thereto, as shown in FIG. 6, wherein the one or more hooks 160 are configured to interlock with the securing member shown in FIGS. 3A-3B.

Figure 8:
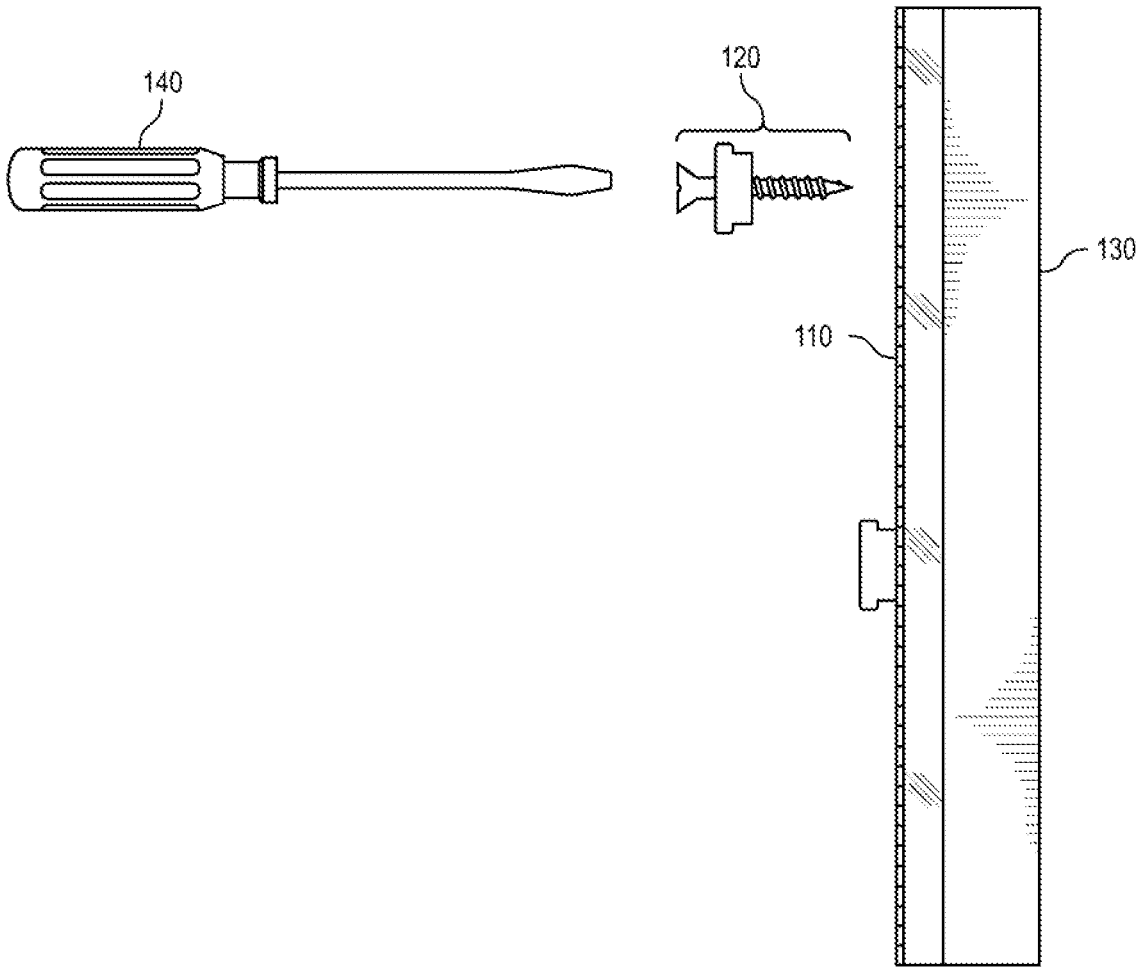
FIG. 8 shows a side view of an enclosure system embodying features consistent with the present disclosure.

In another alternative embodiment, as shown in FIG. 8, the securing member 120 may be a screw with optional washer combination that passes through the panel member assembly 110 to secure the panel member assembly 110 to a structure 130. As further shown in FIG. 8, in such embodiments, the securing member 120 may be secured to the structure 130 using a conventional hand or power tool 140. One of skill in the art will appreciate that the depiction of a screw in FIG. 8 is for illustrative purposes only and that nails, bolts, staples, or any other similar device or instrument may be used.

Figure 11:
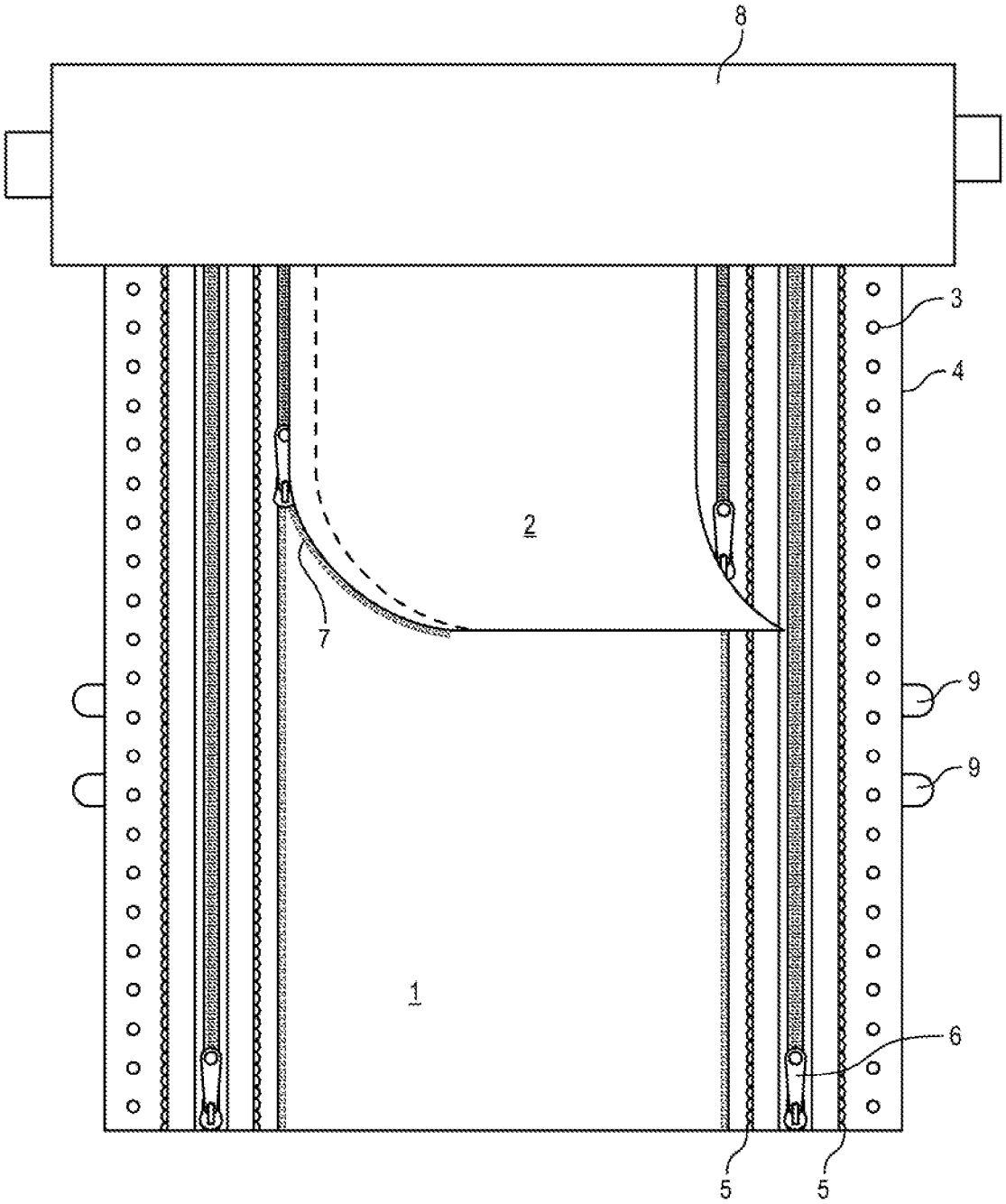
FIG. 11 shows a panel enclosure system embodying features consistent with the principles of the present disclosure.

FIG. 11 shows a panel enclosure system that allows for self-storage, in accordance with one embodiment of the present invention. The panel enclosure system comprises a screen 1 made of a sheet or plastic. The screen or panel 1 presents a transparent, opaque or semi-transparent material. The screen 1 provides a clear part or clear material 2 that allows light to pass through. The screen 1 includes buttons 3 at the assemble point 4 that allow attachment to the structure such as building columns, for example. The buttons 3 extend along the entire length of the screen 1. The screen 1 includes stitches 5. The screen 1 includes first zippers 6. Further, the screen 1 includes second zippers 7 that open and close. At the top, the panel enclosure system comprises an assembly containment pouch 8. The assembly containment pouch 8 receives the entire panel enclosure system when it is folded and provides portability for easy storage (as a pouch) and transport. At the sides, the panel enclosure system comprises elastic attachments 9 that help to tie the panel enclosure system when it is folded. The above disclosed panel enclosure system allows the panel assembly to be rolled up for complete removal of the entire panel enclosure system from the building.

Figure 12:
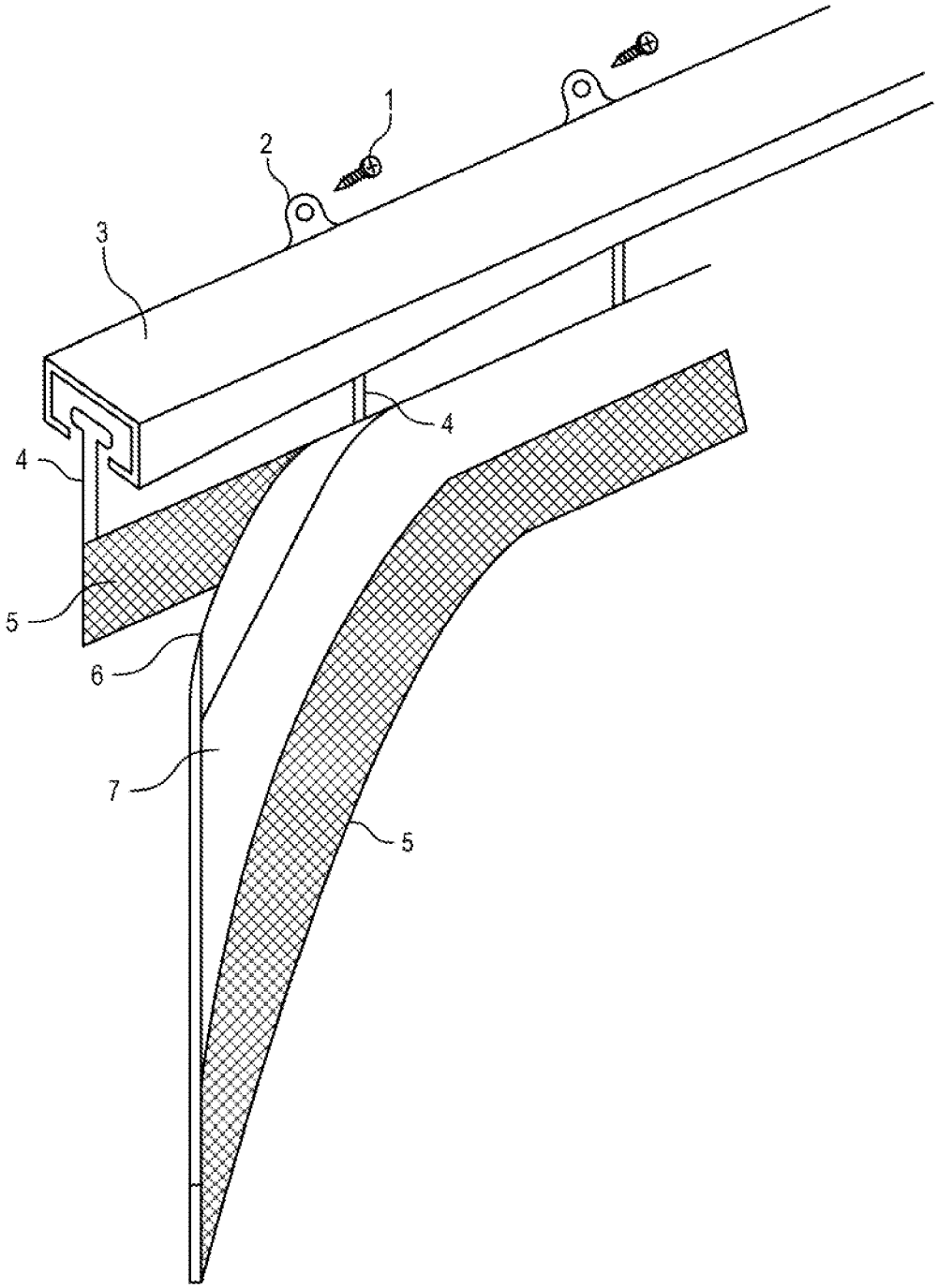
FIG. 12 shows a garage enclosure system embodying features consistent with the principles of the present disclosure.

FIG. 12 shows a perspective view of a garage enclosure system, in accordance with one embodiment of the present invention. As can be seen, an attachment screw 1 connects to a hanger 2 at the top of a rail or securing member 3 of the panel enclosure system. The securing member 3 positions at the top of the structure. The securing member 3 receives the panel member assembly i.e., first panel member 4 and second panel member 7. The first panel member 4 and the second panel member 7 hang downwardly from the securing member 3 and create an upright barrier for the structure. In other words, the securing member 3 receives the first panel member or slider 4 and the second panel member or screen 7. The first panel member 4 attached to the second panel member 7 slide through the securing member 3 and connect to a first connecting member 5 and the cloth portion of the second connecting member 6, respectively. From the above, a person skilled in the art understands that the first connecting member 5 connects to the second panel member or screen 7. The garage enclosure system disclosed herein can be disassembled easily from the structure.

Figure 13:
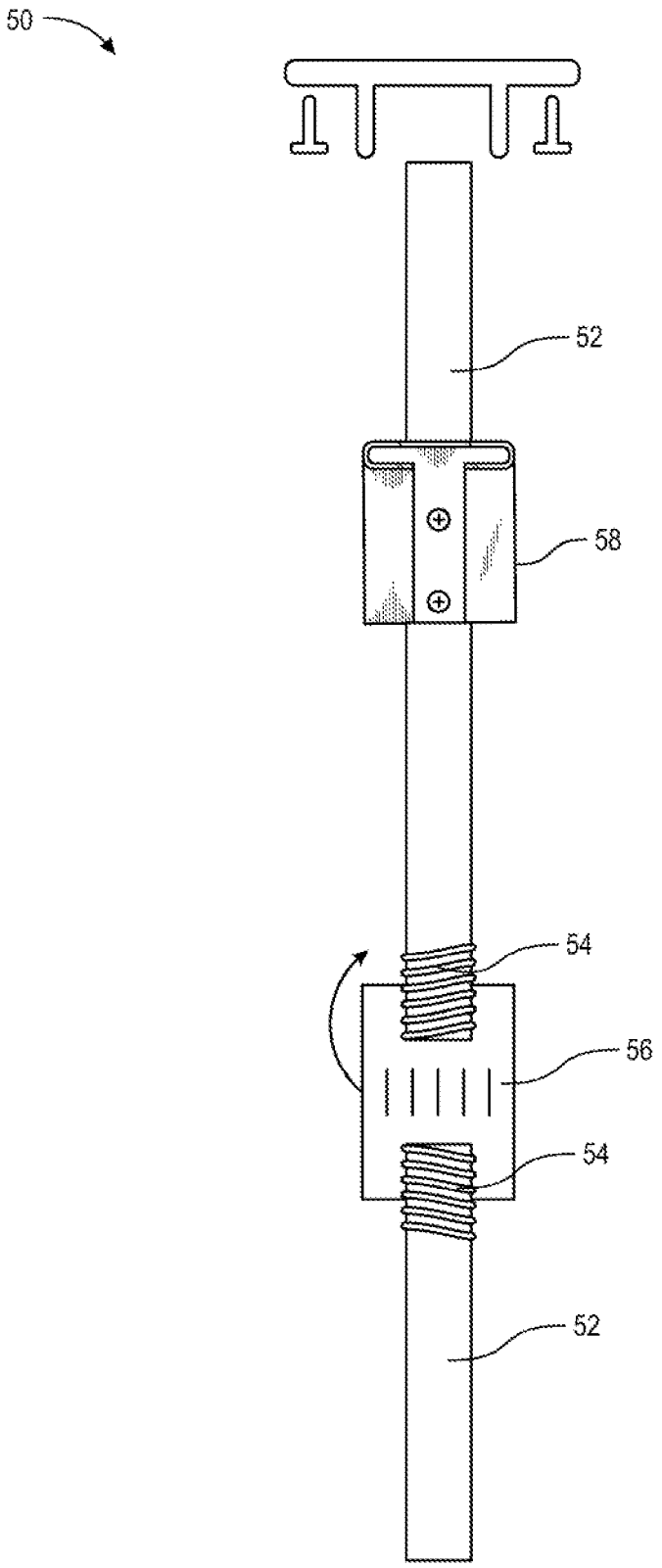
FIG. 13 shows an expandable column embodying features consistent with the principles of the present disclosure.

FIG. 13 represents an expandable column 50 that connects to a panel enclosure system, in accordance with one exemplary embodiment of the present invention. The expandable column 50 provides a way to reduce the movement of the panel enclosure system caused by the wind. The expandable column 50 can be used for structures such as 2 or 3 car garages. The expandable column 50 presents two poles 52, each with threaded portion 54. The poles 52 connect with the help of a nut 56 that acts as a height adjuster. The poles 52 expand or retract at the nut 56 and adjust the length of the expandable column 50 to keep the expandable column 50 steady during the operation. As can be seen, the expandable column 50 connects to a securing member 58 for receiving the panel member assembly. The expandable column 50 helps to adjust the height of the panel enclosure system.

Figure 14:
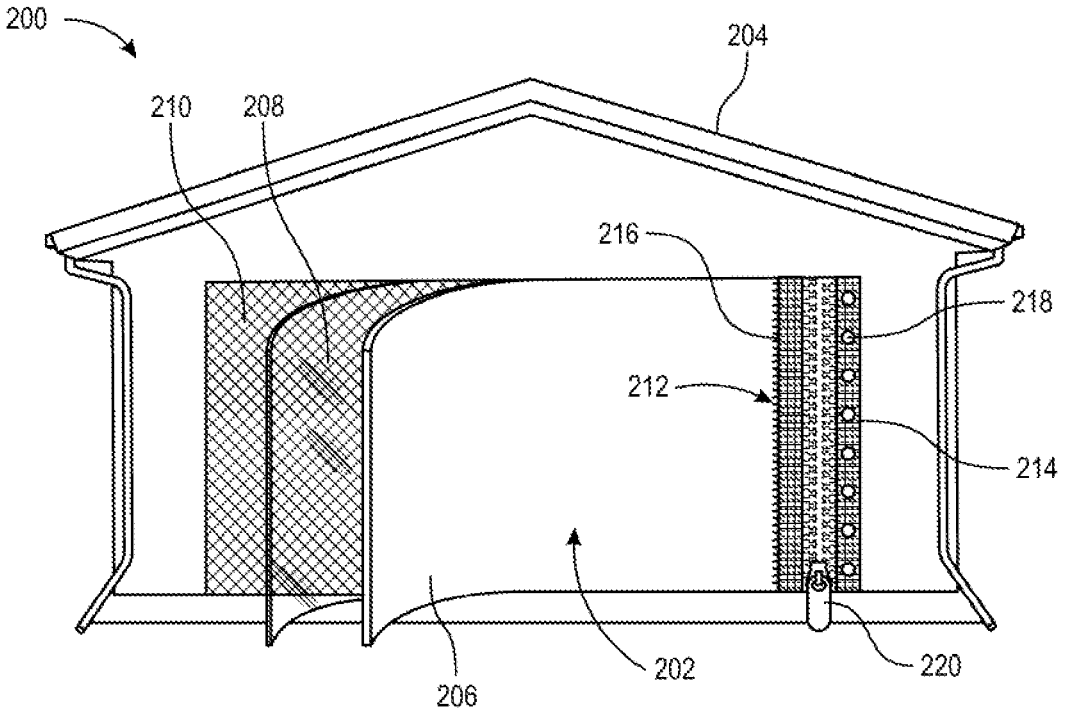
FIG. 14 shows a panel enclosure system embodying features consistent with the principles of the present disclosure.

FIG. 14 shows an environment 200 in which a panel enclosure system 202 implements at a structure 204. Here, the structure 204 indicates a house or any other temporary or permanent structure such as a building or garage. The panel enclosure system 202 comprises a first panel member 206, a second panel member 208, and a third panel member 210. Each of the first panel member 206, the second panel member 208, and the third panel member 210 presents a material made of transparent, opaque or semi-transparent material. For example, the first panel member 206 is made of opaque material. The second panel member 208 is made of transparent material. The third panel member 210 is made of semi-transparent material. A person skilled in the art understands that each of the first panel member 206, the second panel member 208, and the third panel member 210 has a thickness depending on the need.

In one implementation, each of the first panel member 206, the second panel member 208, and the third panel member 210 comprises different degrees of transparency. As each of the first panel member 206, the second panel member 208, and the third panel member 210 has a different transparency, each of them permits a different amount of light to pass therethrough.

A user adds or removes the first panel member 206, the second panel member 208, and the third panel member 210 selectively to vary the degree of visual exposure from the inside the structure 204 to the outdoor environment. Further, the user adds or removes the first panel member 206, the second panel member 208, and the third panel member 210 selectively to regulate temperature within the structure 204 enclosed or partially enclosed by the panel enclosure system 202.

The panel enclosure system 202 further comprises a panel connecting system 212. The panel connecting system 212 allows attaching and separating the panel enclosure system 202 to the structure 204, in accordance with one embodiment of the present invention. In one example, the panel connecting system 212 comprises a zipper mechanism. However, it is possible to connect and separate the panel enclosure system 202 from the structure 204 using any other known mechanisms without departing from the scope of the present invention.

In one implementation, the panel connecting system 212 comprises a first zipper 214 and a second zipper 216. Here, each of the first zipper 214 and the second zipper 216 indicates a zipper tape with elements/teeth. In other words, each of the first zipper 214 and the second zipper 216 indicates a half-portion of a zipper tape. The first zipper 214 connects to the structure 204. The second zipper 216 connects to the panel enclosure system 202 say to the first panel member 206, for example. In one example, the first zipper 214 connects to the structure 204 using screws or fasteners 218. Further, the second zipper 216 is sewn to the panel enclosure system 202 i.e., to one of the first panel member 206, the second panel member 208, and the third panel member 210. A person skilled in the art understands that each of the first zipper 214 and the second zipper 216 can be connected to the panel enclosure system 202 and the structure 204 using a variety of known mechanisms such as adhesive, hook and loop, etc.

The first zipper 214 and the second zipper 216 receive a zipper slider 220. The zipper slider 220 slides along the length of the first zipper 214 and the second zipper 216 and helps to connect and separate the panel enclosure system 202 from the structure 204. The zipper slider 220 is closed (i.e., by bringing the first zipper 214 and the second zipper 216 closer), to connect the panel enclosure system 202 to the structure 204. The zipper slider 220 is opened (i.e., by separating the first zipper 214 and the second zipper 216 apart), to separate/disconnect the panel enclosure system 202 from the structure 204. The panel connecting system 212 helps to attach or detach the panel enclosure system 202 to the structure 204. As such, the panel enclosure system 202 can be attached to the structure 204 when needed. In one example, the panel enclosure system 202 is attached to the structure 204 with the help of the panel connecting system 212 to regulate the temperature or permit the amount of light inside the structure 204. When it is not needed, the panel connecting system 212 is detached thereby separating the panel enclosure system 202 from the structure 204. Although FIG. 14 shows the panel connecting system 212 in a vertical configuration, a person skilled in the art understands that the panel connecting system 212 can be presented in a horizontal or any other configuration without departing from the scope of the present invention.

Figure 15:
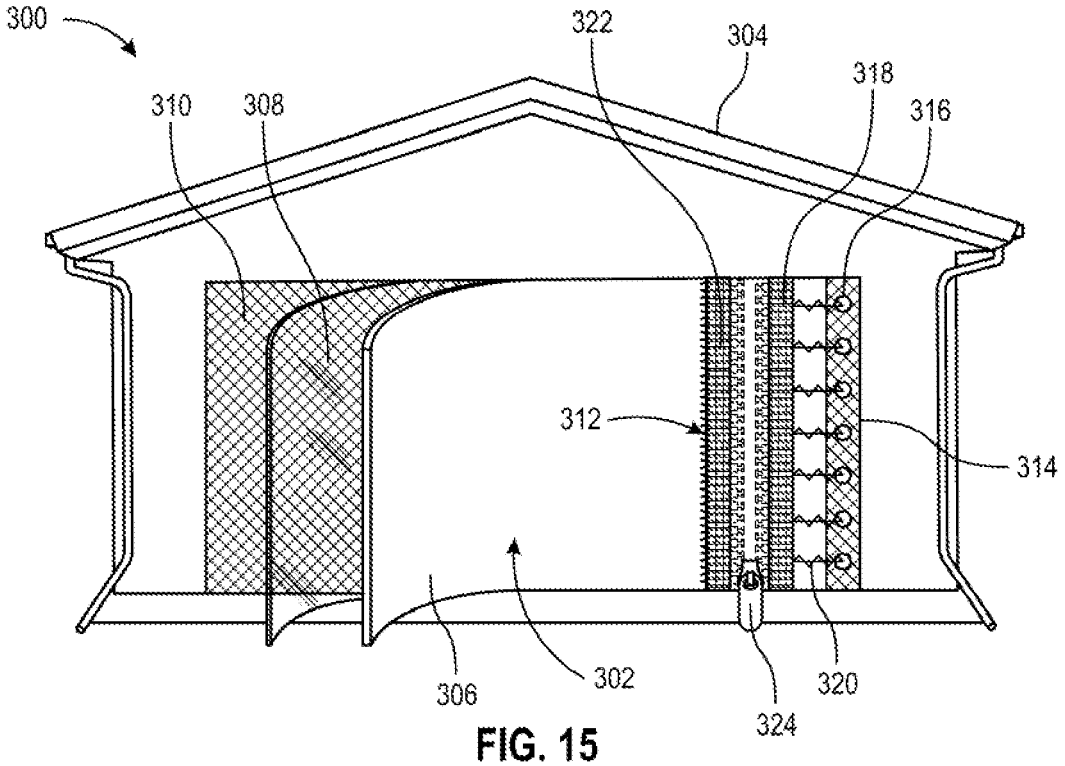
FIG. 15 shows a panel enclosure system embodying features consistent with the principles of the present disclosure.

FIG. 15 shows an environment 300 in which a panel enclosure system 302 implements at a structure 304. Here, the structure 304 indicates a house or any other temporary or permanent structure such as a building erected on the ground. The panel enclosure system 302 comprises a first panel member 306, a second panel member 308, and a third panel member 310. Each of the first panel member 306, the second panel member 308, and the third panel member 310 presents a material made of transparent, opaque or semi-transparent material. For example, the first panel member 306 is made of opaque material. The second panel member 308 is made of transparent material. The third panel member 310 is made of semi-transparent material. A person skilled in the art understands that each of the first panel member 306, the second panel member 308, and the third panel member 310 has a thickness depending on the need.

In one implementation, each of the first panel member 306, the second panel member 308, and the third panel member 310 comprises different degrees of transparency. As each of the first panel member 306, the second panel member 308, and the third panel member 310 has a different transparency, each of them permits a different amount of light to pass therethrough.

As presented above, a user adds or removes the first panel member 306, the second panel member 308, and the third panel member 310 to vary the degree of visual exposure from the inside the structure 304 to the outdoor environment. Further, the user adds or removes the first panel member 306, the second panel member 308, and the third panel member 310 to regulate temperature within the structure 304 enclosed or partially enclosed by the panel member assembly 302.

The panel member assembly 302 further comprises a panel connecting system 312. The panel connecting system 312 allows attaching the panel enclosure system 302 to the structure 304, in accordance with one embodiment of the present invention. In one example, the enclosure system comprises a combination of zipper and hook and loop mechanism. In one implementation, the panel connecting system 312 comprises a strip 314 having a plurality of loops 316. The panel connecting system 312 comprises a first zipper 318 positioned in parallel to the strip 314. The panel connecting system 312 includes hooks 320 that draw through the plurality of loops 316 and connect to the first zipper 318. Here, the hooks 320 draw through the loops 316 stretch. As such, the hooks 320 allow to stretch and reduce the gap between the strip 314 and the first zipper 318. This allows to tighten or loosen the panel enclosure system 302 to the structure 304 depending on the need. Further, the panel connecting system 312 includes a second zipper 322 positioned parallel to the first zipper 318. In one example, the first zipper 318 and/or the second zipper 322 are sewn or connected to the structure using one of a screw mechanism, a hook and loop mechanism, or any other known mechanism without departing from the scope of the present invention. The first zipper 318 and the second zipper 322 receive a zipper slider 324. The zipper slider 324 slides along the length of the first zipper 318 and the second zipper 322 and helps to connect the panel enclosure system 302 to the structure 304. The zipper slider 324 is closed (i.e., by bringing the first zipper 318 and the second zipper 322) for connecting the panel enclosure system 302 connects to the structure 304. The zipper slider 324 is opened (i.e., by separating the first zipper 318 and the second zipper 322 apart) for disconnecting the panel enclosure system 302 disconnects from the structure 304. The panel connecting system 312 helps to stretch the panel enclosure system 302 and attach the panel enclosure system 302 to the structure 304. Further, the panel enclosure system 302 detaches from the structure 304 upon opening the zipper slider 324. A person skilled in the art understands that the present embodiment allows to completely separate the panel enclosure system 302 with the help of zippers and provides a self-tightening mechanism with the help of stretchable hooks and loop mechanism (loops 316 and hooks 320).

Figure 16:
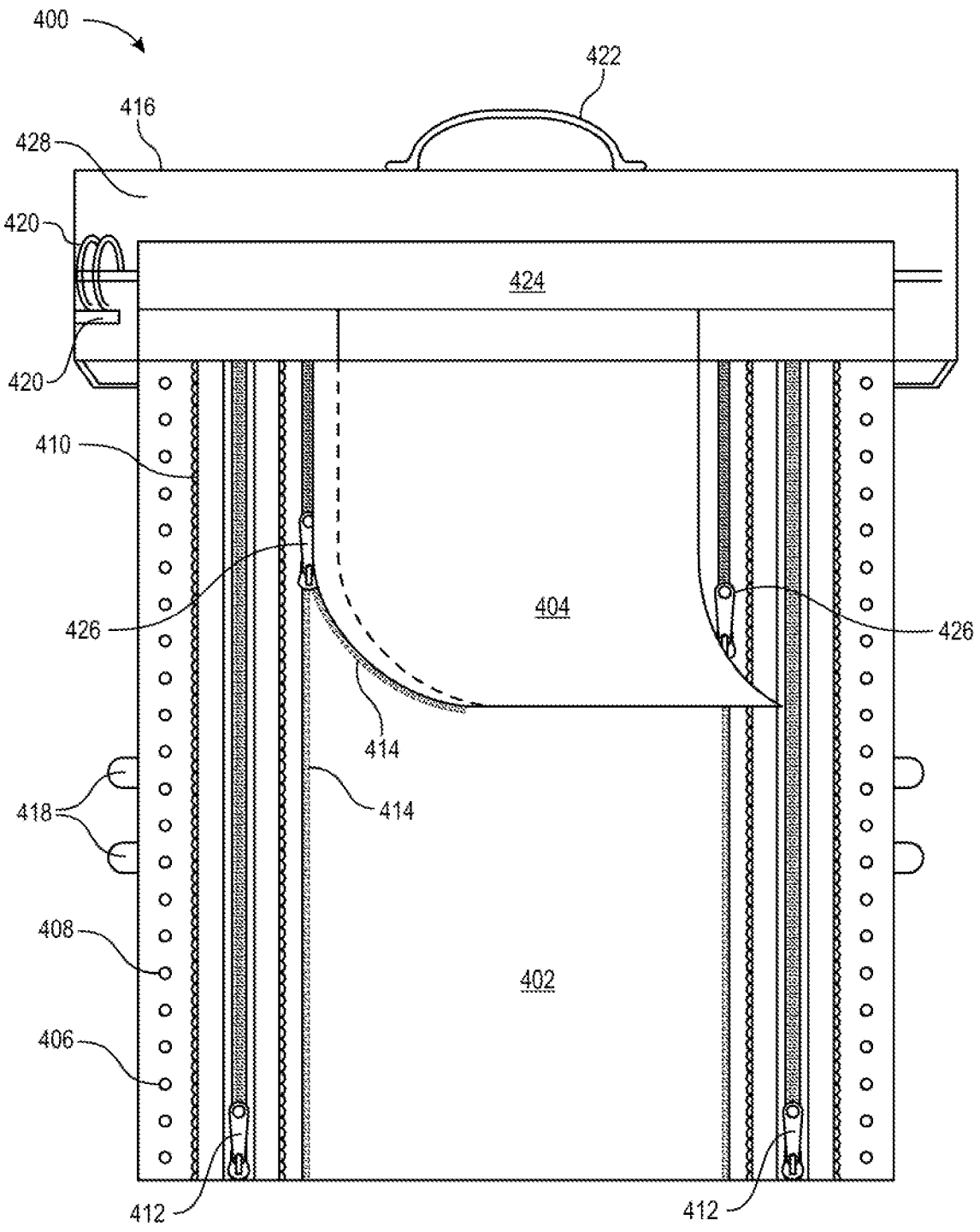
FIG. 16 shows a panel enclosure system embodying features consistent with the principles of the present disclosure.

FIG. 16 shows a panel member assembly 400 that allows for self-storage, in accordance with one embodiment of the present invention. The panel member assembly 400 comprises a screen 402 made of a sheet or plastic. The screen 402 presents a transparent, opaque or semi-transparent material. The screen 402 provides a clear part or clear material 404 that allows light to pass through. The screen 402 includes buttons 406 at the assemble point 408 that allow it to attach to the structure such as building columns, for example. The buttons 406 extend along the entire length of the screen 402. The screen 402 includes stitches 410. The screen 402 includes first zippers 412. Further, the screen 402 includes second zippers 414 that open and close with the help of zipper slider 426. At the top, the panel member assembly 400 comprises an assembly containment pouch 416. The assembly containment pouch 416 receives the entire panel member assembly 400 when it is folded and provides portability for easy storage (as a pouch) and transport. At the sides, the panel member assembly 400 comprises elastic attachments 418 that help to tie the panel member assembly 400 when it is folded. The panel member assembly 400 comprises a height adjustment system 420 that allows to adjust the height of the screen 402 and/or the panel member assembly 400. The panel member assembly 400 comprises a handle 422 at the top of the assembly containment pouch 416 for carrying the panel member assembly 400 in open or folded position. The panel member assembly 400 comprises a screen loader 424. The screen loader 424 helps to load the screen 402 into the assembly containment pouch 416. The screen 402 includes second zippers 414 that open and close with the help of zipper slider 426. The panel member assembly 400 includes screen sleeve 428.

The presently disclosed panel enclosure system provides a portable variable type portioning curtain to mitigate contagious and/or help control room temperature. The presently disclosed panel enclosure system provides a product that prevents unwanted disease or undesirable difference in temperature or weather condition from entering the room. The user can add or remove the panel members selectively to vary the degree of visual exposure from the inside the structure to the outdoor environment. Further, the user can add or remove the panel members selectively to regulate temperature within the structure enclosed or partially enclosed by the panel enclosure system.

The presently disclosed panel member assembly or panel enclosure system provides several advantages. The panel enclosure system provides three individual levels or layers of weather entrances. The panel enclosure system easily transforms from an open port to an enclosed garage. The panel enclosure system allows the user to add or remove the panel members to convert a screen room into a temperature controlled sunroom for winter storage, for plants or a confront area for pets. The panel enclosure system protects people living in the structure from insects that are attracted to light during the night. The panel enclosure system can be used on gazebos for individuals who want to assemble at night. The panel enclosure system comes with its own carrying case i.e., assembly containment pouch. As such, the panel enclosure system can be completely removed from the structure, leaving no evidence of its existence. The panel enclosure system can be used in military motor pools, where there is a lot of equipment maintenance performed at night. The panel enclosure system improves the appearance of structures such as houses with open carports that have non-operational vehicles under them. The panel enclosure system can be used to turn open carports into exercise rooms. The panel enclosure system helps to lower the energy required to heat the building due to infrared heat from the sun during winter months.

It is understood that versions of the inventive subject matter of the present disclosure may come in different forms and embodiments. Additionally, it is understood that one of skill in the art would appreciate these various forms and embodiments as falling within the scope of the inventive subject matter disclosed here.

What is claimed is:

1. A panel enclosure system, comprising:

a panel member assembly comprising a first panel member removably secured to a second panel member, wherein the first panel member coextensively positions over the second panel member, and wherein a transparency of the second panel member is greater than a transparency of the first panel member;

a securing member positioned at a structure, wherein the securing member receives the panel member assembly such that the panel member assembly hangs downwardly from the securing member and creates an upright barrier for the structure; and a panel connecting system positioned at the panel member assembly, wherein the panel connecting system facilitates in connecting and separating the panel member assembly from the structure, wherein the panel connecting system comprises a combination of a zipper mechanism and a hook and loop mechanism, wherein the hook and loop mechanism comprises a strip, wherein the strip connects to the structure, wherein the strip comprises loops, wherein the hook and loop mechanism further comprises a first zipper, wherein the hook and loop mechanism comprises hooks drawn through the loops and connecting the first zipper, wherein the zipper mechanism comprises a second zipper connecting the panel member assembly, wherein the first zipper and the second zipper receive a zipper slider, and wherein the zipper slider slides along the first zipper and the second zipper for connecting and separating the panel member assembly from the structure.

2. The panel enclosure system of claim 1, further comprises an assembly containment pouch, wherein the panel member assembly folds and sits in the assembly containment pouch for easy storage and transport.

3. The panel enclosure system of claim 2, further comprises a handle for carrying the assembly containment pouch containing the panel member assembly.

4. The panel enclosure system of claim 1, wherein the panel member assembly further comprises a third panel member.

5. The panel enclosure system of claim 4, wherein the third panel member has a plurality of openings therein.

6. The panel enclosure system of claim 4, wherein the first panel member is opaque, the second panel member is transparent, and the third panel member is semi-transparent.

7. A panel enclosure system, comprising:

a panel member assembly comprising a first panel member, a second panel member, and a third panel member positioned in coextensive relation to one another, wherein a transparency of each of the first panel member, the second panel member, and the third panel member is different from one another;

a securing member positioned at a structure, wherein the securing member receives the panel member assembly such that the panel member assembly hangs downwardly from the securing member and creates an upright barrier for the structure; and a panel connecting system positioned at the panel member assembly, wherein the panel connecting system facilitates in connecting and separating the panel member assembly from the structure, wherein the panel connecting system comprises a combination of a zipper mechanism and a hook and loop mechanism, wherein the hook and loop mechanism comprises a strip, wherein the strip connects to the structure, wherein the strip comprises loops, wherein the hook and loop mechanism further comprises a first zipper, wherein the hook and loop mechanism comprises hooks drawn through the loops and connecting the first zipper, wherein the zipper mechanism comprises a second zipper connecting the panel member assembly, wherein the first zipper and the second zipper receive a zipper slider, and wherein the zipper slider slides along the first zipper and the second zipper for connecting and separating the panel member assembly from the structure.

8. The panel enclosure system of claim 7, wherein each of the first panel member, the second panel member, and the third panel member is removably secured to at least one other panel member within the panel member assembly.

9. The panel enclosure system of claim 7, wherein the first panel member has a first connecting member, the second panel member has a first connecting member and a second connecting member, and the third panel member has a second connecting member, wherein the first connecting member of the first panel member and the second connecting member of the second panel removably secure the first panel member and second panel member together, and wherein the first connecting member of the second panel member, and the second connecting member of the third panel member removably secure the second panel member and the third panel member together.

10. The panel enclosure system of claim 7, wherein the first panel member is opaque, the second panel member is transparent, and the third panel member is semi-transparent.

11. The panel enclosure system of claim 7, further comprises an expandable column for adjusting the height of the panel enclosure system.

12. The panel enclosure system of claim 7, further comprises an assembly containment pouch, wherein the panel member assembly folds and sits in the assembly containment pouch for easy storage and transport.

13. The panel enclosure system of claim 12, further comprises a handle for carrying the assembly containment pouch containing the panel member assembly.

* * * * *